US006708825B2

(12) United States Patent
Filion et al.

(10) Patent No.: US 6,708,825 B2
(45) Date of Patent: Mar. 23, 2004

(54) CHILD-PROOF PACKAGE FOR PHARMACEUTICAL PRODUCTS

(75) Inventors: Daniel Filion, Pierrefond (CA); Jean Andre Prud'homme, Pincourt (CA)

(73) Assignee: Alcan International Limited, Montreal (CA)

( * ) Notice: Subject to any disclaimer, the term of this patent is extended or adjusted under 35 U.S.C. 154(b) by 0 days.

(21) Appl. No.: 10/086,371

(22) Filed: Mar. 4, 2002

(65) Prior Publication Data

US 2002/0166792 A1 Nov. 14, 2002

Related U.S. Application Data

(63) Continuation-in-part of application No. 09/986,525, filed on Nov. 9, 2001.

(30) Foreign Application Priority Data

Apr. 18, 2001 (CH) ..... 0702/01

(51) Int. Cl.[7] ..... B65D 83/04
(52) U.S. Cl. ..... 206/531; 206/532
(58) Field of Search ..... 206/468, 531, 206/532, 469, 528, 530, 534.1, 534

(56) References Cited

U.S. PATENT DOCUMENTS

| | | | | |
|---|---|---|---|---|
| 2,968,391 A | * | 1/1961 | Sparks | 206/532 |
| 2,971,638 A | * | 2/1961 | Allison et al. | 206/532 |
| 3,182,789 A | | 5/1965 | Sparks | 206/42 |
| 3,905,479 A | * | 9/1975 | Gerner et al. | 206/531 |
| 4,125,190 A | * | 11/1978 | Davie et al. | 206/532 |
| 4,506,789 A | | 3/1985 | Dlugosz | 206/532 |
| 4,537,312 A | | 8/1985 | Intini | 206/531 |
| 4,988,004 A | | 1/1991 | Intini | 206/532 |
| 5,150,793 A | | 9/1992 | Tannenbaum | 206/531 |
| 5,172,812 A | | 12/1992 | Wharton et al. | 206/531 |
| 5,339,960 A | | 8/1994 | Price | 206/531 |
| 5,469,968 A | | 11/1995 | Matthews et al. | 206/532 |
| 5,529,188 A | | 6/1996 | Coggswell | 206/531 |
| 5,927,500 A | * | 7/1999 | Godfrey et al. | 206/531 |
| 6,394,275 B1 | * | 5/2002 | Paliotta et al. | 206/531 |

FOREIGN PATENT DOCUMENTS

| | | |
|---|---|---|
| BE | 752 952 A | 12/1970 |
| EP | 0 774 948 B1 | 11/1998 |
| EP | 1 057 745 A1 | 12/2000 |
| EP | 1 057 750 A1 | 12/2000 |
| WO | WO 96/03329 A1 | 2/1996 |

* cited by examiner

*Primary Examiner*—David T. Fidei

(57) ABSTRACT

A form of child-proof package for tablets and similar pharmaceutical products, features a blister pack with at least one blister which is closed off by a push-through type foil lid, the blister serving the purpose of accommodating the tablets. For the purpose of removing the tablets, the push-through type foil lid of the blister pack lies against a wall part and with respect to that can be displaced by sliding from a closed position to an open position so that, when in the open position, the blister with the tablets lie in line with openings in the wall part and the tablets can be pushed through the openings. The blister pack is arranged between a rear wall part and a front part, and the wall part with the openings lies between the rear wall part and the foil lid. The blisters can be displaced by sliding from the closed position to the open position into opening slits and the openings in the inner wall part are covered over by a tear-off strip which is arranged in the rear wall part and can be separated from it along a line of weakness forming a longitudinal slit.

20 Claims, 4 Drawing Sheets

CHILD-PROOF PACKAGE FOR PHARMACEUTICAL PRODUCTS

CROSS-REFERENCE TO RELATED APPLICATION

This application is a continuation-in-part of our prior patent application Ser. No. 09/986,525 filed Nov. 9, 2001 (pending).

BACKGROUND OF THE INVENTION

1. Field of the Invention

The present invention relates to child-proof packages for pharmaceutical products in the form of solid, pulverized or liquid to pasty doses as e.g. tablets, capsules, ampoules or dragées, featuring a blister pack with at least one blister which is closed off by a push-through type foil lid, the blister serving the purpose of accommodating the pharmaceutical product(s). The packaging is such that, for the purpose of removing the pharmaceutical product, the push-through type foil lid of the blister pack lies against a wall part which protects the foil lid and with respect to which the blister can optionally be displaced by sliding from a closed position to an open position so that, when in the open position, the blister with the pharmaceutical product lie in line with openings in the wall part and the pharmaceutical product can be pushed through the openings.

2. Background Art

The danger of uncontrolled consumption of medicaments is undisputed; in particular, small children are especially exposed to this potential danger in the form of medicaments that have been left lying around.

The most common form of packaging for tablets and similar pharmaceutical products is that of blister packs. Widely known in particular is the so called push-through pack which is such that the tablet is pressed out of a cup in the base part of the pack (the so-called "blister") and through a foil lid. Another known form of blister pack is such that a foil lid is removed by peeling. Other blister packs feature a notch as an aid to tearing.

The present day possibilities for increasing child safety in connection with blister packs mainly involve increasing the difficulty of opening by means of measures that require greater strength, e.g. thicker push-through films, greater force of adhesion of peeling films, or higher force of friction in the case of tearing notches.

Forms of packaging which can be opened only by applying greater force are indeed more child proof, but can present problems for senior citizens.

Known from International patent application WO-A-96/03329 is a child-proof form of packaging in which the lid film of the blister pack is covered by a rear wall part. Integrated into this rear wall part are tearing strips that can be removed along a line of weakness. In order to be able to push the tablet out of the blister through the lid film, the tearing strips have to be removed first.

A child-proof packaging of the kind mentioned at the start of this specification has been disclosed in the U.S. Pat. No. 5,150,793 which issued on Sep. 29, 1992 to PCI/Delvco Inc.

SUMMARY OF THE INVENTION

An object of the present invention is to provide a form of packaging of the kind mentioned at the start of this specification such that a combination capability is necessary to open it or a simultaneous or complex sequence of movements must be carried out.

According to one aspect of the present invention, there is provided a child-proof package for pharmaceutical product (s), comprising a blister pack with at least one blister which is closed off by a push-through type foil lid, the blister serving the purpose of accommodating the pharmaceutical product(s), the packaging being such that, for the purpose of removing the pharmaceutical product(s), the push-through type foil lid of the blister pack lies against a covering wall part with respect to which the blister pack can be displaced by sliding from a closed position to an open position so that, when in the open position, the blister with the pharmaceutical product(s) lies in line with openings in the covering wall part and the pharmaceutical product, can be pushed through the openings, wherein the blister pack is arranged between a rear wall part and a front part and the covering wall part with the openings is an inner wall part lying between the rear wall part and the foil lid, whereby the blisters can be displaced by sliding from the closed position to the open position into opening slits and the openings in the inner wall part are covered over by a tear-off strip which is arranged in the rear wall part and can be separated from it along a line of weakness thus forming a longitudinal slit.

According to another aspect of the invention, there is provided a child-proof package for tablets and similar pharmaceutical products, comprising a blister pack with at least one blister which is closed off by a push-through type foil lid, the blister serving the purpose of accommodating the pharmaceutical product(s), the packaging being such that, for the purpose of removing the pharmaceutical product(s), the push-through type foil lid of the blister pack lies against a covering wall part with respect to which the blister pack can be displaced by sliding from a closed position, where the foil lid lies adjacent to a solid region of the covering wall part, to an open position in which the blister with the pharmaceutical product(s) lies in line with a tear-off strip in the covering wall part, such that when the tear-off strip is removed to create an opening in the covering wall part, the pharmaceutical product(s) can be pushed through the foil lid and the opening in the covering wall part.

Thus, the blister pack is preferably arranged between a rear wall part, and a front part, and the covering wall part with the openings is an inner wall part lying between the rear wall part and the foil lid, whereby the blisters can be displaced by sliding from the closed position to the open position into opening slits and the openings in the inner wall part are covered over by a tear-off strip which is arranged in the rear wall part and can be separated from it along a line of weakness thus forming a longitudinal slit.

The packaging according to the above-mentioned aspects of the invention thus combines tear-off strips and a blister pack that can be displaced by sliding in the packaging as preferred elements that serve the purposes of child safety, and results in a packaging arrangement providing greater child safety than conventional forms of packaging.

Opening the packaging according to the above-mentioned aspects of the invention requires combination skill that recognizes that, in order to push the pharmaceutical product (s) out, the blister pack has to be moved to a particular position and also that it is necessary to remove a tear-off strip from a wall part of the packaging.

The wall parts of the packaging may consist of cardboard or a plastic material, e.g. PVC (polyvinyl chloride). The wall parts may be single-layer or multi-layer parts, where the latter parts may contain a combination of cardboard and plastic materials.

The opening slits may be arranged perpendicular to the tear-off strips. In this case the displacement of the blister pack is perpendicular to the direction of the tear-off strip. In an embodiment where the package contains an inner wall part, the opening slits may also run parallel to and over the tear-off strips. In this case the displacement of the blister pack is in the longitudinal direction of the tear-off strips.

The front part and the inner wall part are preferably joined by means of e.g. gluing or hot sealing at their peripheries at least in part and such that the blister pack lying in between can be displaced by sliding in the longitudinal direction of the opening slit. The rear wall part and the inner wall part are preferably at least in part or all-over joined by means of e.g. gluing or hot sealing in the region surrounding the tear-off strip, so that children are not able to tear off the rear wall from the inner wall when the tear-off strip is torn off.

An additional layer can be attached to the front part on its side facing the blister pack. The additional layer can be provided at least in part, i.e. in the region of the opening slits, or all-over. Further an additional layer can be attached to the rear wall part on its side facing the blister pack. The additional layer can be provided at least in part, i.e. in the region surrounding the tear-off strips, or all-over. The additional layers are e.g. made of a plastic material, preferably of PVC, and they can e.g. be glued, heat sealed or laminated. The additional layers serves to prevent tearing the front part with respect to the rear wall part.

In order to increase child safety further the resistance to sliding displacement of the blister can be increased in that the opening slits exhibit narrow regions, breakable barriers or other suitable means between the closed position and the open position. The greater frictional resistance to the blister at the narrow regions in the opening slits has to be overcome by stronger pressure applied by the fingers. Further the opening slit may be closed with a tear-off strip, whereby the tear-off strip is joined to the front part e.g. by a line of weakness, preferably a line of perforations. By tearing off the strip, the opening slit is freed an the blister is movable.

The arrangement of the inner wall part offers the advantage that, after removing the tear-off strip the foil lid of the blister pack is still not visible. In order that the openings in the inner wall part are also not readily visible, these can be covered by an opening closure that can be pushed through. The opening closure can be a defined area of the inner wall part which is delimited by a closed line of weakness, e.g. a notched or stamped line.

Further, it has also been found advantageous to cover the inner wall part on its side facing the rear wall part and/or on its side facing the foil lid with a protective layer of plastic material. The plastic material is preferably a PVC-layer. The protective layer can be laminated, heat sealed or glued onto the inner wall part. As a result this removes the possibility of small children in particular exposing the prepared openings after removal of the tear-off strips and possibly other rear wall parts.

According to a further aspect of the invention there is provided a child-proof package for tablets and similar pharmaceutical products, comprising a blister pack with at least one blister which is closed off by a push-through type foil lid, the blister serving the purpose of accommodating the pharmaceutical product(s), the packaging being such that the push-through type foil lid of the blister pack lies against a covering wall part, whereby the covering wall part is a multi-layer part and contains an inner layer facing the foil lid of the blister and an outer layer. The outer layer may be bonded to the inner layer in part or all-over. The inner layer contains an opening covered by a push-through opening closure which is delimited by line of weakness. The opening closure lies for the purpose of removing the pharmaceutical product over the blister. The outer layer contains an opening which lies on the opening closure. The said opening is preferably a hatch-like opening. The opening and the opening closures are preferably circular and the opening is preferably concentrically arranged on the opening closure. The opening of the outer layer is preferably equal or smaller than the opening closure. That is to say, the diameter of the opening of the outer layer is preferably equal or smaller than the diameter of the opening closure. The outer layer features an annular region surrounding the opening. The annular region of the outer layer is not bonded to the inner layer. The annular region is delimited towards the plane outer layer by means of a line of weakness, e.g. a circular line of perforations. The annular region preferably contains radial lines of weakness, e.g. cuts or lines of perforations, which subdivide the annular region into sectors. If the opening is smaller than the opening closure then the line of weakness of the opening closure is protected under the annular region and on pressing out the pharmaceutical product, the individual sectors stick out in the shape of a crown or a bloom. The inner layer is preferably made of cardboard and the outer layer is preferably made of a plastic material, e.g. PVC.

The described annular region represents a mean for diversion of attention of the children, which first try to open the packaging by detaching the loosened annular region, particularly the loosened sectors, from the laminate. This way children hardly pay attention to the underlying opening closure.

A rear wall part may be arranged adjacent to the outer layer facing of the covering wall part, whereby the opening of the covering wall part is covered over by a tear-off strip which is arranged in the rear wall part and can be separated from it along a line of weakness thereby forming a longitudinal slit.

A further contribution to increasing child safety in the packaging according to the invention can be made by special shaping of the tear-off strip. This exhibits preferably a gripping flange that terminates in an edge part of the rear wall part, that is freed from it only after bending the edge part, and can then be gripped between two fingers. The gripping flange can be delimited from the edge part by means of a cut or line of weakness, e.g. a punched line or a line of perforations, so that after bending the edge part the gripping flange is freed along the line of weakness and sticks out of the edge part.

As a further contribution to increasing child safety in the packaging, means, e.g. spring-loaded elements, can be provided which automatically set back the unhanded blister pack from the opened to the closed position by displacing in the opening slit.

The package according the invention can contain one or more cups which are movable individual or together in groups. The cups of a blister pack containing a number of cups may e.g. be arranged and movable in rows or in columns. In this case the cups may be movable horizontal or vertical with regard to the rows and columns of cups. In the embodiment where the movement of the cups is perpendicular to a row or a column of cups the displacement of the row or column is preferably only successful by pushing at least two cups at once. The sliding displacement by pushing e.g. only one single cup of a row or column affects that the blister pack tilts in a diagonal position in such a manner that at maximum one cup of the row or column does move into line with the openings in the adjacent wall.

The packaging according the invention can be developed in the form of a single card containing at least one blister pack with at least one cup, where the cups are arranged in rows and columns. Further the packaging may be developed in the form of a foldable strip shaped card with several segments that can be folded, where the segments may contain blister packs as forgoing described.

A useful design of the packaging according to the invention comprises of a strip-shaped card which can be folded together, whereby in the folded state one end part is folded over a first folding axis onto a middle part and is covered by a lid part folded over a second folding axis. A blister pack is preferably provided in both the middle part and in the end part, whereby the blister pack in the middle contains a daily dose e.g. of a first kind of table or similar pharmaceutical product intended to be taken in the morning and the blister pack in the end part contains the daily dose of a second kind of tablet or similar pharmaceutical product to be taken in the evening.

In a first version of the packaging according to the invention the opening slits may be arranged perpendicular to the tear-off strips. In a second version, the opening slits are arranged parallel to and over the tear-off strips.

The line of weakness in the wall part to delimit the tear-off strip is preferably a line of perforations.

BRIEF DESCRIPTION OF THE DRAWINGS

Further advantages, features and details of the invention are revealed in the following description of preferred exemplified embodiments and with the aid of the drawing, in which.

DETAILED DESCRIPTION OF THE INVENTION

Figure 1:
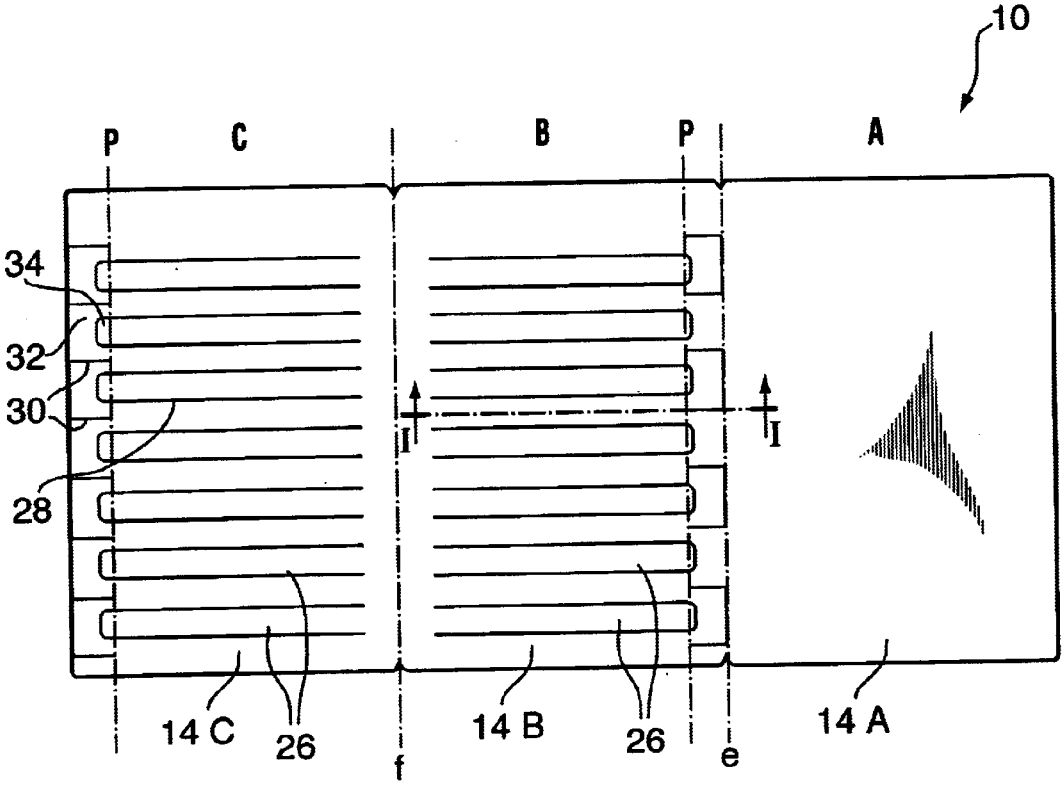
FIG. 1 is a plan view of the rear side of a packaging for tablets, which has been folded open.
Figure 2:
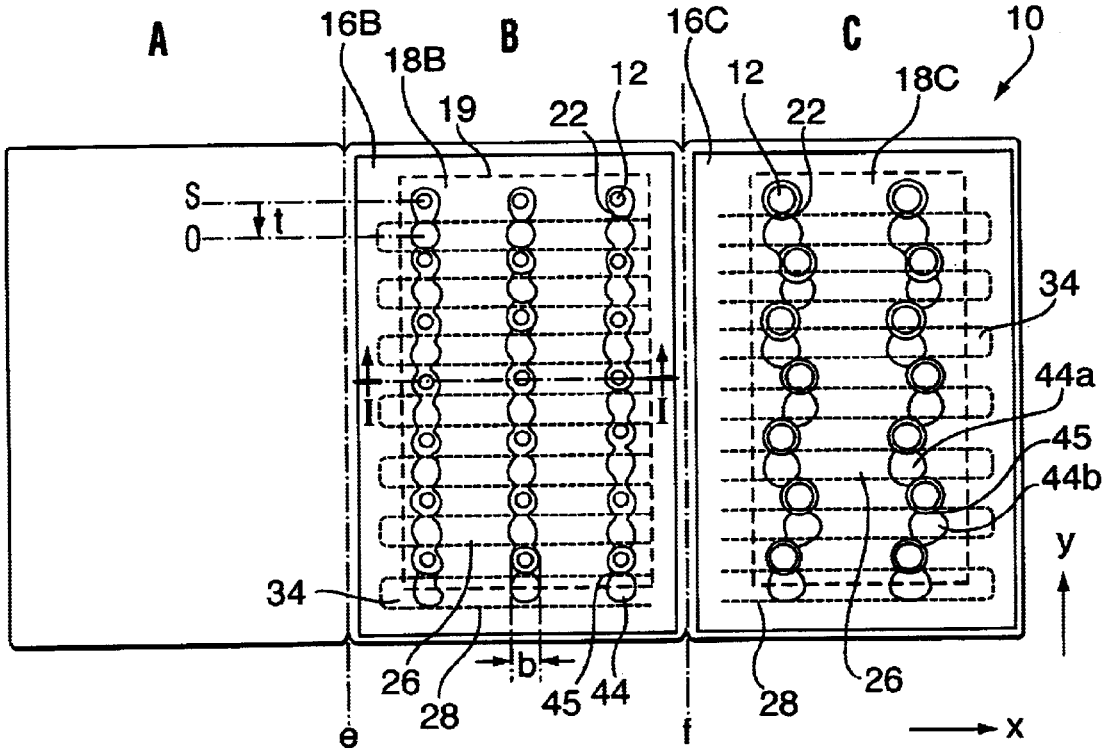
FIG. 2 is plan view of the inner side of the folded open packaging shown in FIG. 1.

A package 10 for tablets 12 or similar pharmaceutical products (e.g. liquid-filled or solids-filled capsules, etc.) is shown in FIGS. 1 and 2. The package 10 has the form of a flat elongated rectangular (strip-shaped) card with parts that can be folded together, whereby, in the folded state, one part C is folded along a first folding axis f onto a middle part B and is covered by a lid part A folded along a second folding axis e. The size of the package 10 folded together in this manner is about one third of the unfolded strip-shaped card. The card contains rear wall parts 14B, 14C and front wall parts 16B, 16C.

Situated between the rear wall parts 14B and 14C of the middle part B or the end part C and the corresponding front parts 16B and 16C are, in each case, blister packs 18B, 18C. The blister packs 18B, 18C comprise a blister film 20, made for example of PVC, in which blisters or cups 22 are provided, e.g. by thermoforming. The open side of the blister 22 is closed off by a foil lid 24 made, for example, of aluminum foil, through which the contents can be pressed.

In the illustrated embodiment, the middle part B has seven rows of blisters 22, each for three tablets running in a first horizontal direction x, and the end part C has seven rows of blisters 22 each for two tablets running in a first horizontal direction x. Each blister pack 18B, 18C comprises a row of blisters 22. The tablets in the middle part B are, for example, intended to be taken in the morning and those in the end part C to be taken in the evening. The seven rows of tablets correspond to the seven days in the week. The version of packaging 10 shown here corresponds therefore to a weekly pack for consumption of two or three tablets twice daily.

Integrated into each of the rear wall parts 14B, 14C of the middle part B and end part C are seven tear-off strips 26 running in the first, horizontal direction x. The front parts 16B, 16C of the middle part B and end part C exhibit—corresponding to the blister packs 18B, 18C—three or two opening slits 44 running in a second perpendicular direction y. The blisters 22 are introduced from the rear side of the front part 16B into these opening slits 44 in the longitudinal direction of the opening slits 44—the largest opening width b of which slits 44 corresponds basically to the diameter of an individual blister 22 in the blister packs 18B, 18C. The front parts 16B, 16C and the rear wall parts 14D, 14C are joined at their peripheries at least in part and such that the blister packs 18B, 18C lying in between and delimited by its periphery 19 are enclosed in the middle part B and end part C and can be displaced by sliding only in the longitudinal direction y of the opening slit 44. As a result of this limited ability of displacing the blister packs 18B, 18C each row of tablets has two extreme positions—namely, a closed position S and an open position O. The displacement t between both extreme positions of the blister packs 18B, 18C is a result of the limited possibility to displace the blister packs inside the middle part B and end part C or as a result of the corresponding selected length of opening slit 44. The opening slits 44 are selected such that there is preferably a narrowing 45 between the closed position S and the open position O. As a consequence of this narrowing 45, a frictional force of resistance has to be overcome on displacing the blister 22 from the closed position S to the open position O. This feature, i.e. the narrowing 45 of the opening slit 44, results in a significant increase in the child-proof property of the package 10. It is clear that after removing a dosage of tablets 12 the blister packs 18B, 18C must be pushed back into the closed position S to keep the packaging 10 child-proof.

In the example shown here, the pairs of blisters 22 in the end part C of the blister packs 18C are in each case displaced a horizontal distance from each other. In this case, of course, the opening slits in the front part 16C are corresponding in shape and feature regions 44*a*, 44*b* which are displaced with respect to each other.

In the open position O, the tablets 12 are situated in a row—as viewed in their projection onto the plane of the drawing—over the tear-off strip 26 or over a longitudinal slit 27 in the rear wall parts 14B, 14C defined by it.

Figure 3:
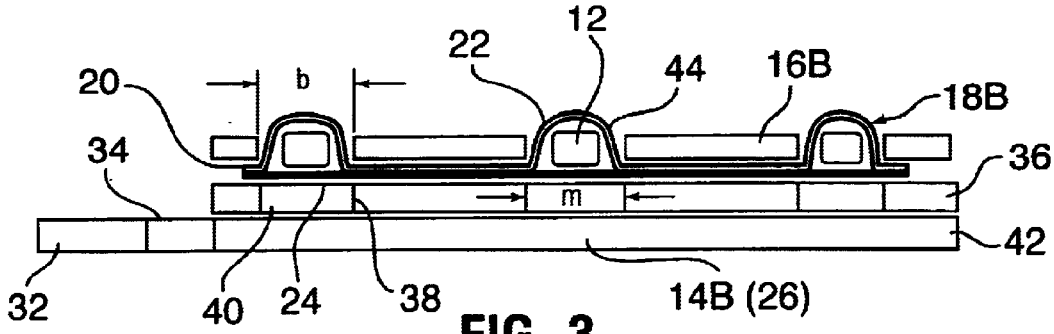
FIG. 3 is a section through the packaging shown in FIGS. 1 and 2 along line I—I in FIGS. 1 and 2.

As shown in FIG. 3, an inner wall 36 is provided on the inner side of the rear wall part 14B, which is made e.g. of cardboard. This inner wall part 36, which is likewise made of cardboard, is preferably provided with a protective layer or film 42 e.g. of PVC (polyvinylchloride) on its side facing rear wall part 14B.

Provided in the inner wall part 36, by means of notches or partially stamping through the inner wall part 36, are openings 38 which in the unopened package are closed off e.g. by the stamped parts 40. The number and arrangement of the openings 38 corresponds to the number and arrangement of the individual blisters 22 in the blister pack 18B. As viewed in their vertical projection to the plane of the middle part B the openings 38 lie within the corresponding opening slits 44 in the front parts 16B, 16C. The diameter m of the openings 38 is chosen to correspond to the diameter of the tablets 12 in such a manner that the tablets can be pushed through the openings without any great effort.

Figure 4:
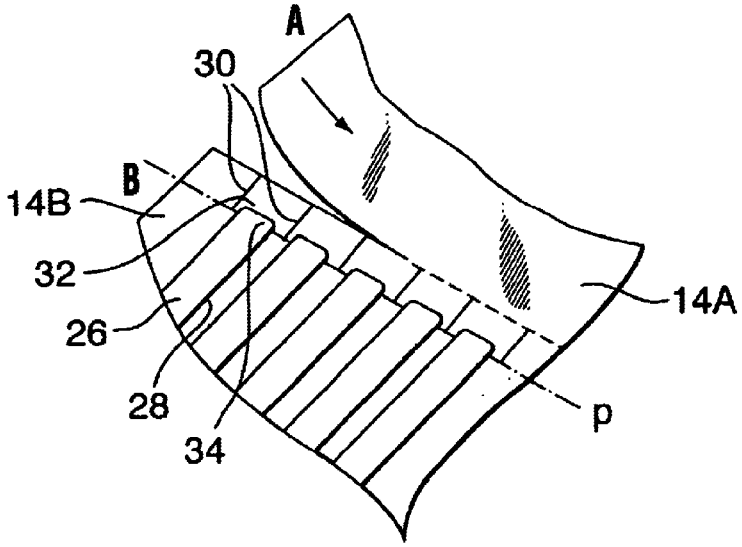
FIG. 4 is a perspective view of the packaging in FIG. 1 during the removal of the cover part.
Figure 5:
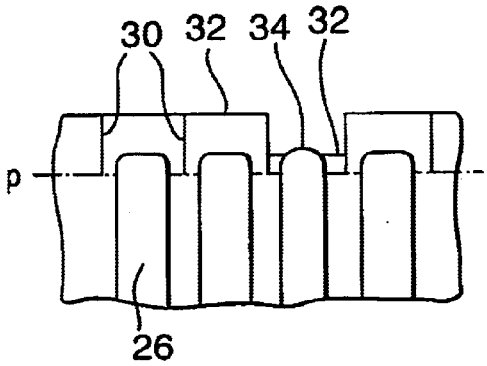
FIG. 5 is a plan view of a part of the packaging in FIG. 4 after removal of the cover part.
Figure 6:
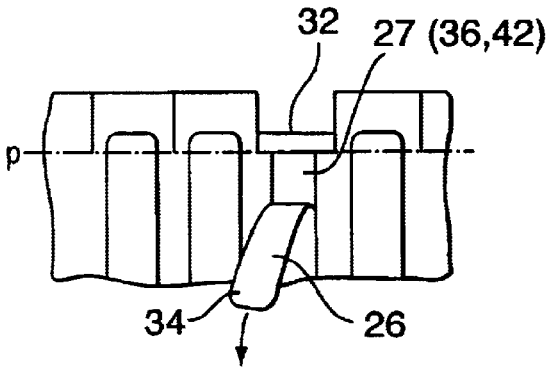
FIG. 6 is a plan view of a part of the packaging in FIG. 5 during the pulling off of a tear-open strip.

The opening of the packaging 10 and the removal of the required daily dose of tablets 12 is described in the following with the aid of FIGS. 4 to 6.

In order to make the tear-off strips 26 in the middle part B accessible, first the cover part A has to be opened from the middle part B. Starting from the edge at the side of the middle part B are cuts 30 which run in the first horizontal direction x parallel to the tear-off strips 26 and form between them edge parts 32 which extend up to a folding line p. Via a line of weakness or perforations 28 along the whole length up to the folding line p, the tear-off strips 26 are releasably attached to the rear wall part 14B. A part of the tear-off strip 26 extending into the edge part 32 is designed as a flange 34 for gripping the tear-off strip 26: whereby in order to form the edge region delimiting the gripping flange 34, the line of weakness 28 of the tear-off strip 26 is punched through in the edge part 32. As a result, on bending back the gripping flange 34 is freed from the edge part 32, i.e. the flange for gripping 34 remains and can be readily gripped between two fingers and the tear-off strip 26 removed from the rest of the back wall panel 14B.

The procedure described for middle part B, i.e. for removing a tear-off strip 26, also applies analogously to end part C, whereby in that case the cuts 30 and therefore the prepared edge parts 32 in rear wall part 14C are already lying free.

After the tear-off strip 26 has been removed from the appropriate rear wall part 14B, 14C for the desired time of day and desired day, the blisters 22 are pushed out of their closed position S by the displacement distance t into the open position O. This displacement takes place at the front side 16B, 16C in such a manner that two fingers engage the blisters lying farthest apart and the blister pack 18B, 18C is pushed parallel to the opening slits 44 by applying pressure simultaneously by both fingers.

If an attempt is made to effect the sliding displacement e.g. by pushing only one single blister 22, the blister pack 18B, 18C tilts in a diagonal position in such a manner that the whole row of tablets does not move into line with the tear-off strip 26. As a result, at most only one tablet can be pressed out of the pack, thus providing increased child safety as small children are hardly able to achieve the required parallel displacement of the blister pack 18B, 18C. In addition to the required parallel displacement of the blister pack 18B, 18C there is the further hindrance in that the narrowing of the opening slits 44 creates resistance to displacement so that the displacement movement which is absolutely necessary to be able to remove the tablets 12 can not be achieved by a small child.

After the desired tear-off strip 26 has been removed and the blister has been brought into the open position O, the tablets can be pressed out of the selected row of individual blisters 22, through the prepared openings 38 and out of the package 10. In the example shown in FIG. 3 the inner wall part 36 is of cardboard optionally laminated, glued or heat sealed with a PVC film acting as a protective layer 42. This results in increased child safety in that after removing one or more tear-off strips 26 or the whole rear wall part 14B, 14C, the pre-stamped or notched openings 38 in the inner wall part 36 are not readily accessible for a small child. The PVC layer prevents small children from being able to free or scratch out the prepared openings 38. Furthermore, the PVC coating makes it necessary to apply additional force to press out the tablets. Of course, other shapes of prepared openings 38 are possible. It is possible for example to prepare the opening by means of a star-shaped cut forming essentially triangular segments, whereby on pressing out the tablet, the individual segments open in the shape of a spiky crown. Likewise, the PVC film, which is used as a protective layer 42, may exhibit a line of weakness that corresponds to the opening formed later.

The rear wall part 14B, 14C may be joined to the underlying inner wall 36 or the protective layer 42 on it, in such a manner that the tear-off strip 26 separates from the underlying wall part 36 or protective layer 42 by peeling.

In the example shown the front parts 16B, 16C are of cardboard as are the rear wall parts 14B, 14C. In order to increase the resistance of the rear wall parts 14A, 14B, 14C and front parts 16B, 16C to tearing, a laminate containing plastic e.g. a cardboard/PVC laminate may be employed.

In the example shown, the opening slits 44 are arranged perpendicular to the tear-off strips 26. It is self-evident that the opening slits 44 may also run parallel to the tear-off slits 26. In this case the displacement of the blister packs 18B, 18C is in the longitudinal direction of the tear-off strips 26. This does not, however, change anything with respect to the basic principle of the orientation of the individual blisters 22 or tablets 12 with corresponding openings 38.

In an embodiment that is slightly different from that of FIG. 1, the blisters of the blister packs are arranged in columns (not shown in the drawings). The opening slits may be vertically arranged, i.e. the blister packs are vertically displaced, according FIG. 2, whereby no tilting of the columns of the blister packs will occur by pushing only one single blister. The opening slits may also be horizontally arranged, i.e. the moving of the blister packs is horizontally, whereby a tilting of the columns of the blister packs will occur by pushing only one single blister as above described.

Figure 7A:
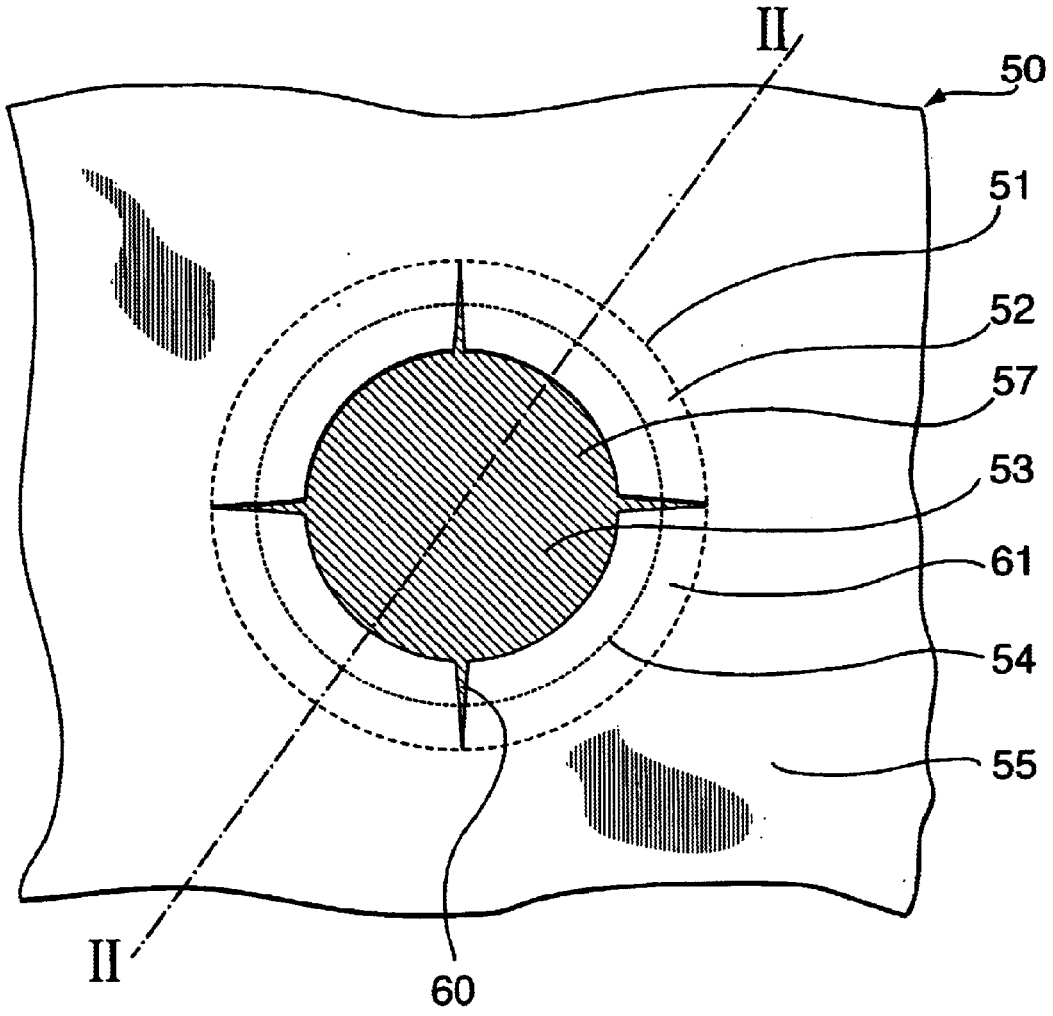
FIG. 7*a* is a plan view of a part of the opening closure of the covering wall part of another embodiment of the invention.
Figure 7B:
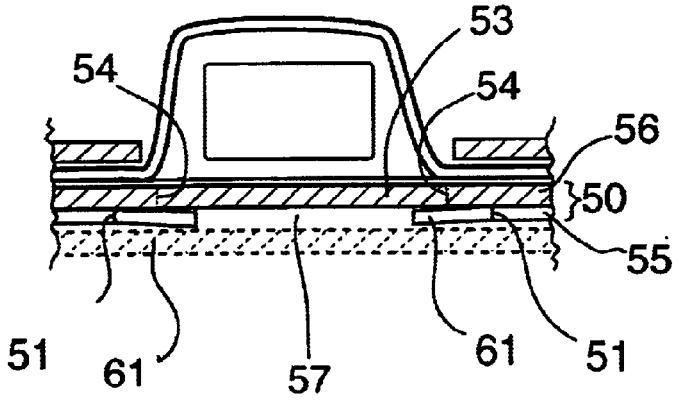
FIG. 7*b* is section through the covering wall part shown in FIG. 7*a* along line II—II in FIG. 7*a*.

FIG. 7*a*, FIG. 7*b* show an embodiment of the covering wall part according to a further aspect of the invention. The covering wall part is a multi-layer part 50 which contains an inner layer 56 facing the foil lid of the blister and an outer layer 55, which may facing a rear wall part. The inner layer 56 contains a circular push-through opening closure 53 which is delimited by a line of perforations 54. The outer layer contains a circular opening 57 which is concentrically arranged on the opening closure 53, whereby the opening 57 is smaller than the opening closure 53. The outer layer 55 features an annular region 61 which surrounds the opening 57 and which is not bonded to the inner layer 56. The annular region 61 is delimited towards the plane outer layer 55 by means of a line of perforations 51. The annular region 61 preferably contains radial cuts 60, which subdivide the annular region 61 into sectors 52. On pressing out the pharmaceutical product, the opening closure 53 is pushed out and the individual sectors 52 open in the shape of a crown.

What we claim is:

1. A child-proof package for pharmaceutical product(s), comprising a blister pack with at least one blister which is closed off by a push-through type foil lid, said at least one blister being adapted to accommodate the pharmaceutical product(s), a front wall part overlying said blister pack and having at least one opening through which said at least one blister projects, a rear wall part underlying said blister pack, said rear wall part being provided with at least one tear-off strip delimited by a line of weakness, which tear-off strip produces a slit in said rear wall part when torn off, and a covering wall part having at least one opening, said covering wall part being positioned between said rear wall part and said blister pack such that the push-through type foil lid of the blister pack lies against said covering wall part with respect to which the blister pack is displaceable by sliding from a closed position to an open position so that, when in the open position, said at least one blister containing the pharmaceutical product(s) lies in line with said at least one opening in the covering wall part allowing the pharmaceutical product(s) to be pushed through the opening, said covering wall part being aligned with said rear wall part such that said at least one opening of said covering wall part is in line with said at least one tear-off strip whereby, when said blister pack is displaced by sliding from the closed position to the open position and said at least one strip is torn off to produce said slit in said rear wall part, said pharmaceutical product can be pushed through said foil lid, said opening in said covering wall part and said slit, thereby removing said pharmaceutical product(s) from the package.

2. The package of claim 1, wherein said at least one opening in said front wall part is shaped in the form of an opening slit to permit said blister pack to be moved from said closed position to said open position, and wherein said opening slit in the front wall part has a narrow region that increases resistance to movement of said blister pack between the closed position and the open position.

3. The package of claim 1, wherein said at least one opening in the covering wall part is covered over by a closure means that can be pushed through.

4. The package of claim 1, wherein the covering wall part is covered over by a protective layer made of a plastic material.

5. The package of claim 1, wherein the covering wall part is a multi-layer part containing an inner layer facing the foil lid and an outer layer facing the rear wall part, the inner layer having an opening closure which can be pushed through and the outer layer having an opening which lies over the opening closure and which is surrounded by an annular region, wherein the annular region is subdivided into sectors which are not bonded to the inner layer and which stick out of the covering wall part in the shape of a crown when the opening closure is pushed through.

6. The package of claim 1, wherein the tear-off strip has a grippable flange that terminates in an edge part of the rear wall part and which, on bending the edge part, is freed from the edge part and sticks out of the edge part, and can be gripped between two fingers.

7. The package of claim 1, wherein the package is in the form of an elongated flat body divided by folding axes into an end part, a middle part and a lid part, such that said flat body can be folded up with said end part folded onto said middle part and covered by said lid part.

8. The package of claim 7, wherein a said blister pack is positioned in the middle part and a second blister pack is arranged in the end part.

9. The package of claim 2, wherein the opening slits of said front wall part are arranged perpendicular to the tear-off strips of said rear wall part.

10. The package of claim 2, wherein the opening slits of the front wall part are arranged parallel to and over the tear-off strips of the rear wall part.

11. The package of claim 1, wherein the line of weakness provided in the rear wall part to delimit the tear-off strip is a line of perforations.

12. A child-proof package for pharmaceutical product(s), comprising a blister pack with at least one blister which is closed off by a push-through type foil lid, the blister serving the purpose of accommodating the pharmaceutical product (s), and a covering wall part covering said push-through type foil lid, said covering wall part having a permanently solid region which cannot be penetrated by said pharmaceutical product(s) pressed against said push-through type foil lid, and a region having a tear-off strip that, when torn off, leaves an opening in the covering wall through which said pharmaceutical product(s) may penetrate when pushed through said foil lid, the packaging being such that, for the purpose of removing the pharmaceutical product(s), blister pack is displaceable by sliding from a closed position, where the blister lies adjacent to said permanently solid region of the covering wall part, to an open position in which the blister with the pharmaceutical product(s) lies in line with said tear-off strip in the covering wall part, such that when the tear-off strip is removed to create an opening in the covering wall part, the pharmaceutical product(s) can be pushed through the foil lid and the opening in the covering wall part.

13. The package of claim 12, wherein the blister pack is arranged between the covering wall part and a front wall part provided with at least one opening slit through which said at least one blister projects, whereby said at least one blister is displaceable by sliding from the closed position to the open position in said opening slits in the front wall part, and wherein the opening slits are provided with narrow regions between the closed position and the open position in order to increase the resistance to displacing the blister by sliding.

14. The package of claim 12, wherein the tear-off strip is provided with a gripping flange that terminates in an edge part of the covering wall part and that is freed from the edge part upon bending of the edge part, thereby sticking out of the edge part, and that is adapted to be grasped between two fingers.

15. The package of claim 13, wherein said at least one opening slit in the front wall part is arranged perpendicular to the tear-off strip in the covering wall part.

16. The package of claim 12, wherein a line of perforations is provided in the covering wall part to delimit the tear-off strip.

17. A child-proof package for pharmaceutical product(s), comprising a blister pack having at least one blister, a push-through type foil lid closing off said at least one blister, said blister serving the purpose of accommodating the pharmaceutical product(s), and a covering wall part lying against said push-through type foil lid, wherein the covering wall part is a multi-layer part containing an inner layer facing the foil lid and an outer layer, the inner layer having an opening covered by an opening closure that is adapted to be pushed through and the outer layer having an opening which lies on the opening closure and which opening of the outer layer is surrounded by an annular region not bonded to the inner layer.

18. The package of claim 17, wherein the opening of the outer layer is smaller then the opening closure.

19. The package of claim 17, wherein the annular region is subdivided in sectors which are not bonded to the inner layer and which stick out of the covering wall part in the shape of a crown when the opening closure is pushed through.

20. The package of claim 17, wherein a rear wall part is arranged adjacent to the outer layer and facing the covering wall part, said rear wall part including a tear-off strip defined by a line of weakness that allows the tear-off strip to be removed from the rear wall part to form a longitudinal slit, whereby the openings of the covering wall part are covered over by the tear-off strip until said tear-off strip is removed, whereupon said opening of the covering wall part are aligned with said longitudinal slit.

* * * * *